US006623200B1

(12) United States Patent
Gueret

(10) Patent No.: US 6,623,200 B1
(45) Date of Patent: Sep. 23, 2003

(54) APPLICATOR DEVICE AND SYSTEM HAVING PARTICLE-LADEN BRISTLES, METHOD FOR APPLYING PRODUCT, AND METHOD OF MAKING PARTICLE-LADEN BRISTLES

(75) Inventor: Jean-Louis H. Gueret, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/709,397

(22) Filed: Nov. 13, 2000

(30) Foreign Application Priority Data

Nov. 10, 1999 (FR) ..... 99 14149

(51) Int. Cl.[7] ..... A46B 11/00

(52) U.S. Cl. ..... 401/129; 401/126; 401/122; 15/207.2

(58) Field of Search ..... 401/129, 126, 401/122, 118; 15/207, 207.2; 300/21

(56) References Cited

U.S. PATENT DOCUMENTS

| | | | | |
|---|---|---|---|---|
| 3,325,845 A | * | 6/1967 | Sawkiw | 15/207.2 |
| 4,571,768 A | | 2/1986 | Kawashima | |
| 4,927,281 A | | 5/1990 | Gueret | |
| 4,958,402 A | * | 9/1990 | Weihrauch | 15/159 A |
| 4,993,440 A | | 2/1991 | Gueret | |
| 5,161,554 A | | 11/1992 | Fitjer | |
| 5,269,040 A | | 12/1993 | Switall | |
| 5,349,972 A | | 9/1994 | Dirksing et al. | |
| 5,357,647 A | | 10/1994 | Gueret | |
| 5,386,278 A | * | 1/1995 | Maeyama et al. | 15/207.5 |
| 5,567,072 A | | 10/1996 | Dunleavy et al. | |
| 5,762,432 A | | 6/1998 | Dunleavy et al. | |
| 5,987,691 A | * | 11/1999 | Jurt et al. | 15/207.2 |
| 6,039,487 A | * | 3/2000 | Kristiansen | 401/126 |
| 6,073,634 A | | 6/2000 | Gueret | |
| 6,079,087 A | * | 6/2000 | Cansler | 28/279 |
| 6,163,918 A | * | 12/2000 | Weihrauch | 15/207.2 |
| 6,174,600 B1 | | 1/2001 | Brown et al. | |
| 6,269,514 B1 | * | 8/2001 | Edwards et al. | 15/159.1 |
| 6,311,359 B1 | * | 11/2001 | Brezler, III | 15/159.1 |

FOREIGN PATENT DOCUMENTS

| | | |
|---|---|---|
| DE | 195 34 368 | 3/1997 |
| FR | 2 607 372 | 6/1988 |
| FR | 2 627 068 | 8/1989 |
| FR | 2 687 055 | 8/1993 |
| JP | 61-141307 | 6/1986 |
| JP | 61-187808 | 8/1986 |
| JP | 2001-178541 | 7/2001 |
| WO | WO 00/02468 | 1/2000 |

OTHER PUBLICATIONS

English Language Translation of JP 61–187808, Aug. 21, 1986.

English Language Derwent Abstract of JP 2001–178541, Jul. 3, 2001.

Co–pending Application No. 10/094,660, Title: Device for Applying a Product and Method for Manufacturing Device, Inventor: Jean–Louis H. Gueret, U.S. Filing Date: Mar. 12, 2002.

Co–pending Application No. 10/161,726; Title: Fiber and Device for Applying a Product, and Method of Manufacturing Device, Inventor: Jean–Louis H. Gueret, U.S. Filing Date: Jun. 5, 2002.

English language Derwent Abstract of DE 195 34 368.

* cited by examiner

*Primary Examiner*—David J. Walczak
(74) *Attorney, Agent, or Firm*—Finnegan, Henderson, Farabow, Garrett & Dunner, L.L.P.

(57) ABSTRACT

An application device for applying a cosmetic product includes a wand, and an applicator member on the wand. The applicator member includes a plurality of bristles configured to apply a cosmetic product. Some of bristles include a plurality of particles providing roughness on at least a portion of the outer surface of the bristles. The application device can be used in a cosmetic application system having a reservoir. The reservoir is configured to contain a cosmetic product capable of being applied with the application device.

104 Claims, 4 Drawing Sheets

APPLICATOR DEVICE AND SYSTEM HAVING PARTICLE-LADEN BRISTLES, METHOD FOR APPLYING PRODUCT, AND METHOD OF MAKING PARTICLE-LADEN BRISTLES

The present invention relates to an applicator device having a number of bristles for applying a product of liquid to pasty or pulverulent consistency, for example, a cosmetic or dermatological product. The device can be used to apply the product to a surface, such as the skin and its superficial body growths. The present invention also relates to an application system containing the product and equipped with such an application device.

The application system may include a reservoir containing the product. The reservoir includes an open end to which a handle of the device may be removably attached. The handle (i.e. grasping element) may be configured in the form of a stopper. The stopper may be secured to an applicator member, generally via a wand, so that when the assembly is closed, the applicator member may become impregnated with the said product.

The reservoir is, for example, intended to contain a make-up product or a dermatological product, such as a mascara, a liquid lipstick, an eyeliner, a powder of the blusher type, an eyeshadow, a nail varnish, or a hair treatment. A dose of this product is picked up on such an applicator and applied to the surface that is to be treated.

Numerous applicators have been proposed in the past with a view to applying mascara to the eyelashes, varnish to the nails, make-up powder to the cheeks or eyelids, or dye to the hair. With a view to increasing the amount of product retained on the applicator, it has been proposed that one or more longitudinal capillary grooves be made along the surface of the bristles embedded in the applicator.

Thus, FR-A-2 607 372 and FR-A-2 627 068 disclose mascara brushes including bristles which have, at their surface, at least one capillary groove extending in a straight line over the entire length of the bristles. Capillary grooves constitute reserves of mascara, allowing the mascara to be transferred quickly and efficiently to the eyelashes at the time of application, with a view to an even application of make-up.

Furthermore, FR-A-2 687 055 discloses a nail varnish applicator which has a tuft of roughly parallel bristles. This tuft may have two types of bristles having different diameters, wherein the bristles may have at least one longitudinal capillary groove.

In general, the bristles used for making most conventional applicators have smooth surfaces, because they are manufactured by extruding a thermoplastic material through a die. These applicators may give satisfactory results. However, particularly when loading them with a given product, it has become preferable to have an applicator which makes it possible to apply make-up which is both very heavy and very uniform, even for products of highly varying nature (hydrophilic-lipophilic).

Some conventional applicators, such as mascara applicators, may have the drawback of losing a good proportion of their load of product, particularly when the applicator member is subjected to a wringing-out operation prior to the application of the product. In the case of a mascara brush, if the free ends of the bristles are scraped by a wringing-out lip while the centre of the brush contains a mass of product, the mass of product may dry out between uses.

For some conventional nail varnish brushes, satisfactory loading of product may be obtained. However, for certain nail varnish compositions there is a poor affinity for the material of which the brush bristles are formed. In other words, if a bristle made of a given material gives good results, for example, when the varnish is of the water-based type, it may have a low retaining power when the varnish is one based on an organic solvent. It is therefore desirable to look for bristles made of another material, which has good affinity for this type of organic-solvent based varnish. When the affinity is inappropriate, the varnish runs too quickly and application to the nail is excessive and messy.

DE-A-195 34 368 describes a method for extruding fibres made of a mixture of a thermoplastic material and granules. These fibres can be used, in particular, for making toothbrushes or other devices which have an abrasive action. This document also mentions the use of the fibres for paintbrushes, so as to increase the paint retention.

One preferred object of the invention is to provide an assembly for applying a product, wherein the assembly includes an applicator having, particularly after wringing, a significant reserve of product. Another preferred object of the invention is aimed at an even distribution and controlled release of the product during application, regardless of the nature of the composition intended to be brought into contact with the surface that is to be treated. An applicator such as this may be suited, in particular, to applying make-up to the eyelashes or eyebrows, to the lips, to the skin, to the nails, or to hair, in addition, may be used for dermatological treatment.

Another preferred object of the invention is to provide universal means for an applicator assembly that makes it possible to master the amount of product picked up and the speed at which the product flows at the time of application, regardless of the nature of the product. The present invention preferably achieves this by modifying the surface finish of bristles included on an applicator. The product retention may be thus improved and appropriate affinity between the product and bristles may be created.

It should be understood that the invention could still be practiced without performing one or more of the objects and/or advantages described above. Still other objects will become apparent from the detailed description which follows.

To achieve those and other advantages, and in accordance with the purposes of the invention, as broadly described herein, the invention includes an application device for applying a cosmetic product, including a wand, and an applicator member on the wand. The applicator member includes a plurality of bristles configured to apply a cosmetic product. The plurality of bristles includes at least one bristle having a plurality of particles providing roughness on at least a portion of the outer surface of the bristle.

Another aspect of the present invention provides an application device where the plurality of particles comprise a material chosen from inorganic origin, vegetable origin, or synthetic origin.

A further aspect of the present invention provides an application device where the plurality of particles are chosen from globular particles, lamellar particles, or fibrous particles.

Yet another aspect of the present invention provides an application device where the particles include a material chosen from mica, $CaCo_3$, ZnO, $TiO_2$, MgO, $Al_2O_3$, cotton, cellulose, silica, silicates, talc, clay, urea/formaldehyde, powdered wood, graphite, carbon, at least one metal, or mixtures thereof.

Another aspect of the present invention provides an application device where the size of each of said plurality of particles ranges from about 2 μm to about 500 μm. In a preferred embodiment the size of each of the plurality of particles ranges from about 5 μm to about 200 μm. In another preferred embodiment, the size of each of the plurality of particles ranges from about 10 μm to about 150 μm. Additionally, particles of different natures may be used where their mean sizes differ.

In yet another aspect, the present invention provides an application device where the at least one bristle comprises a matrix and at least some of the plurality of particles are provided therein. Preferably, the matrix comprises a material chosen from polyamide, polyester, polyethylene, polypropylene, polyvinyl chloride, polytetrafluroethylene, polyethylene terephthalate, thermoplastic elastomer, or vulcanized elastomer.

Through an arrangement such as this there is obtained a bristle surface with a coarseness, preferably one perceptible to the touch. Thus, for example, when a mascara brush is equipped with bristles as defined hereinabove, it preferably has a uniform and thick spread of product across the surface of the bristles, even after wringing out. In addition, a brush such as this preferably has a particular ability to catch onto the eyelashes, allowing the lashes to be curled and "lengthened."

Likewise, the present invention could provide a brush for applying a nail varnish that has a quite remarkable affinity for the product that is to be applied. Specifically, varnish deposited on a smooth-surface brush bristle tends to form "beads" which run along the surface of the bristles somewhat swiftly under the effect of gravity. A brush according to the invention, including bristles having surface roughnesses, preferably forms a thicker layer, by comparison with conventional brushes. Thus, the varnish may be better held and run appreciably less swiftly. Furthermore, the loading capacity of the brush according to the invention may be markedly greater than the loading capacity of a conventional smooth-surfaced brush. Depending on the size (height) of the roughnesses and on their surface density, it is preferably easy to control the running of the varnish at the time of its application to the nail. This could apply both for water-based varnishes and for varnishes based on an organic solvent of the ethyl acetate, ketone or butyl acetate type.

Another aspect of the present invention provides an application device where a cross-section of each bristle of the plurality of bristles is sized such that the cross-section fits inside a circle having a diameter ranging from about 6/100ths of a mm to about 30/100ths of a mm. In a preferred embodiment, the cross-section fits inside a circle having a diameter ranging from about 6/100ths of a mm to about 20/100ths of a mm.

Another aspect of the present invention provides an application device where a cross-section of the at least one bristle is sized such that the cross-section has a first mean diameter at a top of each of the particles, and the cross-section has a second mean diameter at a base of each of the particles. The ratio of the first mean diameter to the second mean diameter ranges from about 1.05 to about 1.4

In another aspect of the present invention, the plurality of particles in the at least one bristle make up from about 0.2% to about 20% by volume of the total volume of the at least one bristle. In another embodiment of the present invention, the plurality of particles of the at least one bristle provide from about 2% to about 10% by volume of the total volume of the at least one bristle. In another preferred embodiment, the plurality of particles of the at least one bristle provide from about 2.5% to about 6% by volume of the total volume of the at least one bristle. In another embodiment, the plurality of particles provide from about 0.2% to about 20% by volume of the total volume of the plurality of bristles.

Another aspect of the present invention provides an application device where a shape of an end of at least one of the plurality of bristles is either rounded, tapered, forked, or pinhead shaped. In addition, the bristles may have undergone any kind of treatments known to one of skill in the art. For example, the bristles may be corrugated in a plane or shaped as a stretched out spiral.

In another aspect, the present invention provides an application device where the plurality of bristles includes at least one bristle of a first length and at least one bristle of a second length greater than the first length. In another embodiment, the present invention provides an application device where a length of each of the plurality of bristles ranges from about 2 mm to about 25 mm. For example, in the case of a brush of the "bottle brush" type, the length of a bristle is defined by the distance between its two free ends. In this case, the length of the bristles is, for example, on the order of 7 mm to 12 mm.

Another aspect of the present invention provides an application device where the at least one bristle comprises at least one groove. In a further aspect, the shape of the at least one groove is either longitudinal or helical.

Another aspect of the present invention provides an application device where the at least one bristle comprises at least one ridge. In a further aspect, the shape of the at least one ridge is either longitudinal or helical.

In a different aspect, the present invention provides an application device where a shape of a cross-section of each of the bristles is chosen from a shape of a cross, trilobe, tetralobe, solid oval, hollow oval, solid cylinder, hollow cylinder, solid rectangle, hollow rectangle, triangle, solid polygon, hollow polygon, a figure-8, a C, an E, an F, an H, an I, an L, an N, an S, a T, a V, a W, a star, or a crescent.

In another aspect, the present invention provides an application device where the plurality of bristles includes at least one tuft of bristles extending substantially parallel to one another. One end of each of the bristles in the tuft is fixed to the wand. In a further aspect, the application device includes a handle on an end of the wand opposite to the applicator member. In yet a further aspect, the application device is configured in the form of a nail varnish brush, a blusher brush, a lipstick brush, and an eyeliner brush.

Another aspect of the present invention provides an application where the wand is substantially planar. The applicator member is arranged in a plane of the wand being oriented transversely with respect to a longitudinal axis of the application device. In a further aspect, the plurality of bristles extend substantially parallel to the longitudinal axis of the application device. In yet a further aspect, the device is configured in the form of a mascara brush.

In another aspect, the present invention provides an application device where the applicator member includes a core, and the plurality of bristles extend substantially radially from the core. In a preferred embodiment, the device is configured in the form of a mascara brush. In another aspect, the core includes two twisted-together branches of wire. In another preferred embodiment, the plurality of bristles are trapped between the twisted-together branches of the core. In yet another aspect, the core defines an axis coincident with a central axis of the applicator member. This arrangement may be suited for use as a mascara brush or an applicator for applying hair dye to hair.

Another aspect of the present invention provides an application device where each of the plurality of bristles includes the particles providing roughness. In a different aspect, some of the plurality of bristles lack the particles providing roughness.

Yet another aspect of the present invention provides an application device where the plurality of bristles comprises at least one second bristle including a plurality of particles differing from the plurality of particles of the at least one bristle.

In yet another aspect, the applicator member may have varying external shapes. Thus, the external profile of the applicator defined by the ends of the bristles can be adjusted to suit accordingly to the nature of the product to be applied and the morphology of the surface to be treated. This profile can be obtained by using a trimmer to trim the free ends of the bristles.

Another aspect of the present is directed to a cosmetic application system including an application device, and a reservoir configured to contain a cosmetic product capable of being applied with the application device. The application device includes a wand, and an applicator member on the wand. The applicator member includes a plurality of bristles configured to apply a cosmetic product. The plurality of bristles includes at least one bristle having a plurality of particles providing roughness on at least a portion of the outer surface of the bristle. In a preferred embodiment, the roughnesses can project in random fashion.

A further aspect of the present invention provides an application system where the reservoir contains the cosmetic product. In a preferred embodiment, the cosmetic product is one of an eye make-up product or a nail treatment product.

Another aspect of the present invention provides an application system having a handle on an end of the wand opposite the applicator member, a portion of the handle being configured to removably close an opening in the reservoir. Preferably, the applicator member becomes immersed in product contained in the reservoir when the handle closes the opening.

Yet another aspect of the present invention provides an application system where the reservoir includes an opening and a wiper. The wiper is configured to remove excess product from the applicator member when the applicator member is withdrawn from the reservoir. In another aspect, the wiper is configured to remove excess material form the wand. In a different aspect, the wiper comprises an elastomeric material and includes at least one passage through which the applicator member can pass. In another aspect, the wiper comprises a foam material and includes at least one passage through which the applicator member can pass. In yet another aspect, the wiper includes at least one slit extending across a substantial portion of a cross-section of the wiper.

Another aspect of the present invention provides an application system where the cosmetic product is either mascara or nail varnish.

In a preferred embodiment of the application system, it is possible to provide a wringing-out member which is preferably located near an open end of the reservoir in order to be able to correctly meter the product and spread it uniformly over the applicator member. Preferably, a wringing-out member or wiper can be formed from an elastomeric material, possibly made of foam. The wringing-out member preferably has at least one passage through which can pass, at least in part, the applicator member and, as appropriate, a portion of a wand connecting the applicator member to the element for grasping. The passage in the wringing-out member may comprise at least one open or touching wringing-out lip. When the applicator member is carried by a flat wand, this passage may be in the form of at least one slot.

In the field of applicator assemblies for cosmetic products, the wiper or wringing-out member may serve at least two possible functions. The fist function of a wringing-out member is to remove the excess product picked up by the applicator. The second function is spread the product out evenly over the bristles of the applicator member. As appropriate, the wringing-out member may also wring out all or part of the applicator wand.

In the case of a mascara brush, particularly of the type with a twisted core comprising bristles oriented transversely to the axis of the core, a wringing-out member may have detrimental effects. Specifically, it is often found that when passing through the wringing-out member a conventional mascara brush does not have enough product, particularly on the free portions of the bristles which are intended to come into contact with the eyelashes. However, a large amount of product is often moved along the bristles, after wringing out, toward the core of the applicator, from where the transfer of the product onto the eyelashes cannot be done particularly satisfactorily.

Preferably, the assembly according to the invention, comprising an applicator in which the applicator member comprises bristles with roughnesses as defined previously, makes it possible to minimize these detrimental effects which occur as the applicator member passes through the wringing-out member.

Another aspect of the present invention is directed to a method of applying a cosmetic product to a surface region of a body. The method includes providing an application device as described above, placing a cosmetic product on the applicator member, and transferring the cosmetic product from the applicator member to a surface region of a body. In a further aspect, the cosmetic product is an eye make-up and the surface region includes eyelashes. In a different aspect, the product is a nail treatment product and the surface region includes at least one of either a fingernail or a toenail.

In another aspect of the present invention, a portion of the application device is configured to be grasped by a user during application of the product. The method further includes grasping the portion.

In yet another aspect, the present invention is directed to a method of forming the at least one bristle. The method includes preparing a mixture of a thermoplastic material and a plurality of particles such that particles make up from about 0.2% to about 20% by volume of the total volume of the mixture, heating the mixture, extruding the mixture through a die to form a strand, cooling the strand at least once, raising the temperature of the stand to allow at least some of the particles to emerge at the surface of the strand, and cutting the strand to a desired length for the bristle.

In another aspect, the cooling of the strand includes placing the strand in contact with a bath of liquid at a temperature lower than the temperature of the strand during the extruding.

In a different aspect, the raising the temperature of the strand includes heating the strand in an oven, wherein the strand is heated to about a glass transition temperature of the thermoplastic material.

In yet another aspect, the method includes stretching the strand. In a further aspect, the strand has an initial diameter and the stretching of the strand reduces the diameter of the strand from about 60% to about 90% of the initial diameter.

Apart from the arrangements explained hereinabove, the invention could include a number of other arrangements, some of which will be dealt with more fully hereinafter with regard to some exemplary embodiments described with reference to the appended drawings, but which are not in any way limiting. It is to be understood that both the foregoing description and the following description are exemplary, and are intended to provide further explanation of the invention as claimed.

The accompanying drawings are included to provide a further understanding of the invention and are incorporated in and constitute a part of this specification. The drawings illustrate embodiments of the invention and, together with the description, serve to explain the principles of the invention. In the drawings, FIG. 1A depicts a view in axial section of a mascara applicator assembly according to a first embodiment of the invention;

Figure 1A:
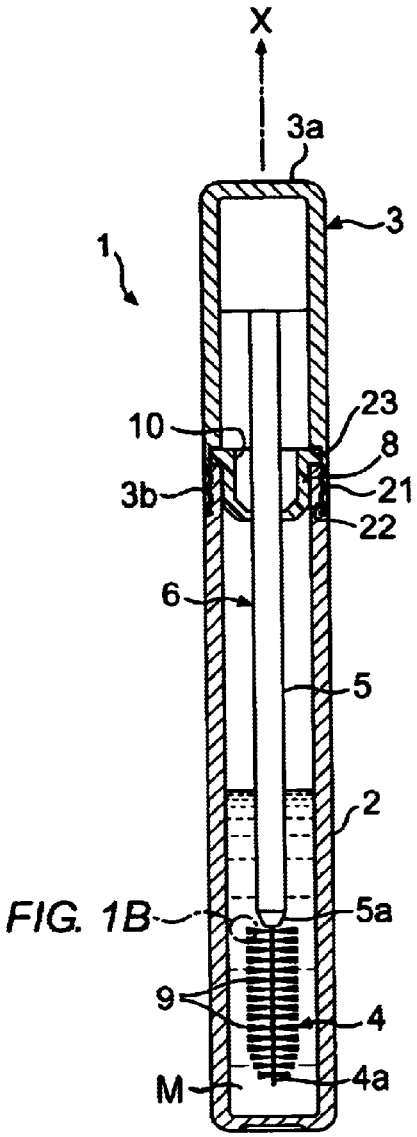
FIG. 1B is a detail view of a portion of a bristle shown in FIG. 1A.

Reference will now be made in detail to the present preferred embodiments of the invention, examples of which are illustrated in the accompanying drawings. Wherever possible, the same reference symbols are used in the drawings and the description to refer to same or like parts, and reference symbols differing by 100 or 200 are used to refer to similar parts.

FIG. 1A shows a mascara applicator assembly 1, having a longitudinal axis X, including an applicator 6 equipped with a sleeve 3 for applying a product M contained in a cylindrical reservoir 2. The applicator 6 is secured to a handle configured in the form of a stopper 3*a* which can be fixed, by screwing, onto the neck 21 of the reservoir and which serves as an element for grasping. The neck 21 has an external screw thread 22 capable of cooperating with a complementary screw thread 3*b* formed on a lower portion of the internal surface of the stopper 3*a*. The stopper 3*a* has the overall shape of an elongate cylinder, allowing it to be held easily in the hand. The stopper 3*a* is equipped with a central wand 5 emerging from the lower side of the stopper 3*a*. This wand 5 has a lower end 5*a* to which an applicator member 4 is fixed, for example by bonding or push-fitting.

The neck 21 of the bottle has a free circular edge 23 defining an opening 10. Mounted in this opening is a wringing-out member 8 made of an elastically deformable material The wringing-out member is in the form of a thimble, the bottom of which faces towards the reservoir 2. The bottom is open, so as to form a circular wringing-out lip capable, as the applicator 6 is extracted from the reservoir, of wringing out first the wand 5 then of removing any excess product on the applicator member 4. In the storage position, the wand 5 passes through the wringing-out member 8.

Figure 1B:
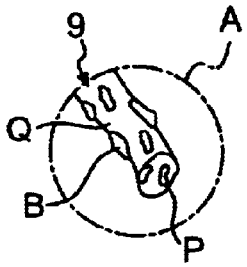

The applicator member 4 as shown in FIG. 1A is a brush for applying mascara to the eyelashes. A brush such as this comprises an elongate core 4*a,* formed by twisting together two branches of a metal wire which have previously been bent into a U-shape. The core 4*a* is forcibly pushed-fitted in the end 5*a* of the wand 5. Bristles 9 are embedded radially between the strand that form the core 4*a*. When the branches of the wire are twisted together, the bristles 9 are gripped and held between the turns of the core 4*a*. FIG. 1B shows an enlarged view of a bristle which has roughnesses B. One or more of the bristles 9 (i.e., some or all of the bristles 9) are configured with such roughnesses B.

These roughnesses are obtained by incorporating particles P into the material of which the bristles 9 are made, so as to form microlumps B spread randomly over the surface of the bristles. Thus, simply to the touch, a bristle 9 such as this has significant coarseness. After the applicator has been extracted from the reservoir, a significant amount of product preferably remains caught between the microlumps B, even after wringing out.

The bristles 9 preferably include a matrix Q, particularly a thermoplastic matrix, containing an appropriate amount of particles P. Examples of the bristles that can be used for the applicators according to the invention are illustrated non-limitingly in FIGS. 1B and 6 to 18. The brush 4 may have a mixture of bristles with roughnesses B of different types (different diameters, shapes, cross sections, elasticities, flexibilities, materials).

A brush such as this may have any known exterior shape obtained, for example, by cutting off the free ends of the bristles 9 using a trimmer.

The brush according to the embodiment of FIGS. 1A and 1B, can be heavily laden with mascara. Upon contact with the eyelashes, the eyelashes preferably become heavily laden with mascara. As the user moves the brush 1 along her eyelashes, the latter continue to be in contact with the brush over the entire length and they are coated, while at the same time being curled.

The bristles of the brush preferably comb the lashes. When the user moves the brush with respect to her eyelashes, the latter are preferably gripped by the bristles by means of the randomly arranged roughnesses B. The product is spread out according to the amount of interpenetration between the eyelashes and the brush, over the entire periphery and along the entire length of each eyelash. The lashes are also combed and lengthened. In addition, thanks to the coarseness, the roughnesses B cause the lashes to catch more firmly on the surface of the bristles 9, so as to obtain a better curling of the lashes.

Preferably, each lash is coated evenly. In addition, there is preferably no appreciable difference in make-up between the lashes at the end of the eyelid and those in the middle. In the preferred practice of this invention, the lashes are perfectly separated from one another, lengthened, and highly curled.

Figure 2A:
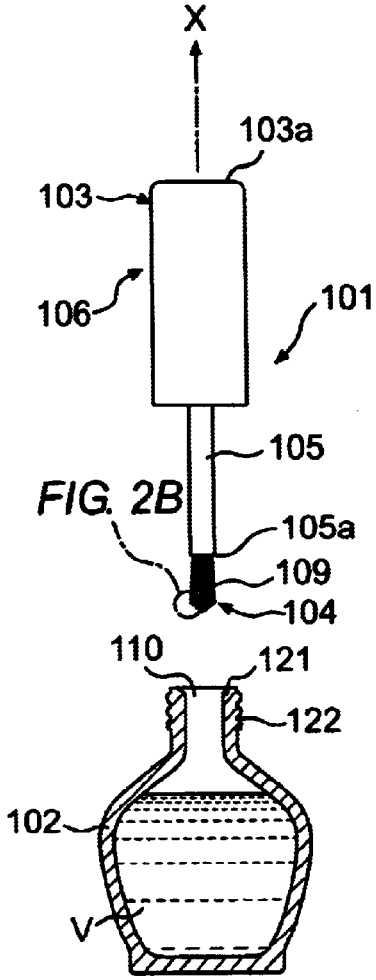
FIG. 2A depicts a view in axial section of a nail varnish applicator assembly according to a second embodiment of the invention.

FIG. 2A shows a second embodiment of an applicator assembly of the liquid nail product type, denoted overall by the reference 101. This assembly comprises a reservoir 102 having a longitudinal axis X of symmetry, and an applicator 106 equipped with a sleeve 103. The reservoir 102, advantageously made of glass, contains a liquid or viscous product V to be applied, for example a nail varnish composition.

The reservoir 102 has a neck 121 defining an opening 110. The neck 121 has an external screw thread 122 capable of cooperating with a complementary neck inside the sleeve 103.

The sleeve 103 is coupled to one end of a wand 105 having another end connected to an applicator member 104 which, in this instance, includes a brush including a tuft of bristles 109 fixed to the free end 105*a* of the wand 105. In the tuft, the bristles are preferably arranged roughly parallel to one another.

Figure 2B:
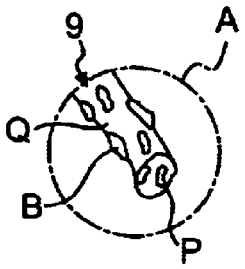
FIG. 2B is a detail view of a portion of a bristle shown in FIG. 2A.

When the applicator assembly is closed by screwing the sleeve 103 on the reservoir 102, the tuft 104 of bristles 109 dips into the product V. One or more of these bristles 109 are configured to have surface roughnesses B, and could be chosen from the bristles shown in FIG. 2B, and in FIGS. 6 to 18, for example.

When the user wishes to apply some product V, she unscrews the sleeve 3 which acts as an element for grasping, and extracts the brush from the reservoir. The brush then usually carries excess product. To wring the brush out, the user wipes it against the free edge of the neck of the bottle 121.

It should be noted that during this operation the brush preferably remains heavily laden and has a good ability to retain the varnish, even after several wringing-out passes. Preferably, varnish is deposited onto the nail at a flow rate which is both low and appreciably constant. In the preferred practice of the invention, the coat of varnish obtained is more even, and the varnish dries quickly.

Figure 3A:
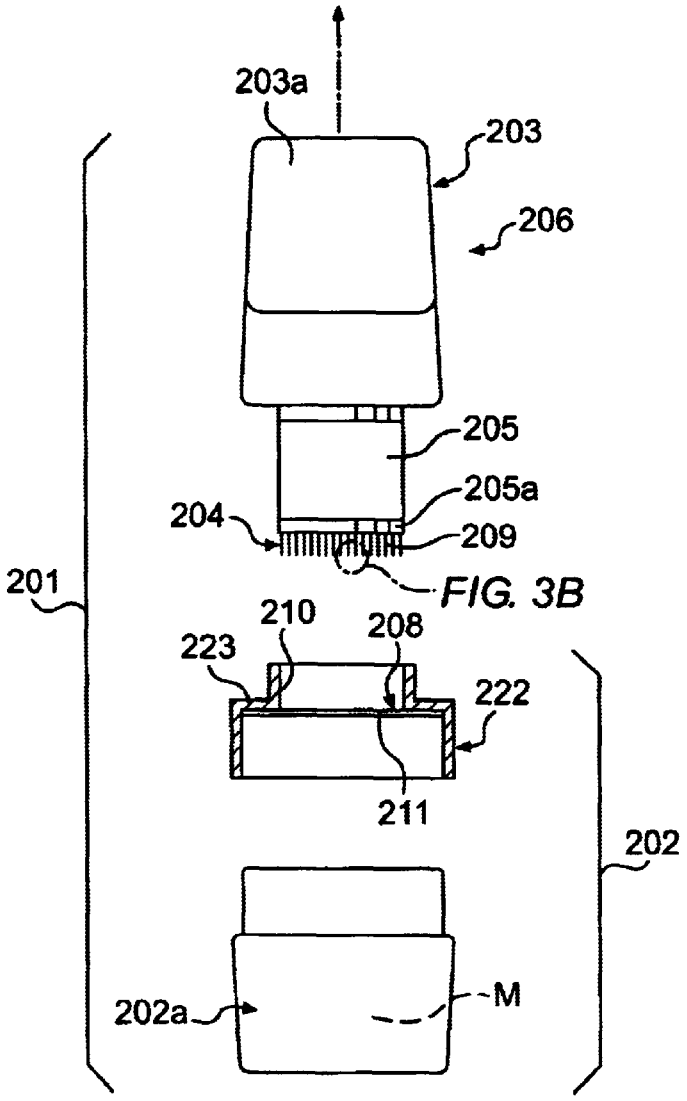
FIG. 3 depicts a view in axial section of a mascara applicator assembly according to a third embodiment of the invention.
Figure 3B:
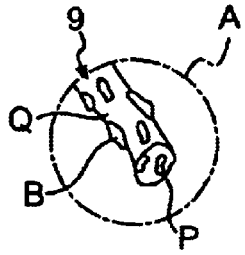

FIG. 3 shows a mascara applicator 206 which differs from the one depicted in FIG. 1 in that its wand 205 is roughly flat. A free end 205*a* of the wand 205 is connected to an applicator member 204 including a collection of bristles 209 arranged in the plane of the wand 205, roughly perpendicular to an axis of the applicator 206. One or more of the bristles 209 preferably have roughnesses, and are of the same type as those described with reference to FIGS. 1 and 2. The other end of the wand 205 is preferably coupled into a sleeve 204 for grasping.

The mascara applicator 206 forms part of a make-up assembly 201 comprising a reservoir 202*a* for a product M, surmounted by a wringer-holder element 222. The wringer-holder element is equipped with an open neck 210 that can be closed off by the grasping sleeve 203. The wringer-holder element further comprises a shoulder 223 on which a wringing-out member 208 is mounted. In this particular instance, the wringing-out member is formed by an elastomer or foam membrane which has a slot 211 through which at last a portion of the wand 205 and the collection of bristles 209 of applicator member 204 can pass. The plane in which the bristles 209 are embedded may also be inclined with respect to the plane passing through the wand 205.

When the applicator 206 is extracted from the reservoir, the brush laden with mascara passes through the wringing-out device 211. The latter wrings out the external face of the bristles. The recesses between the roughnesses B on the bristles constituting substantial microreserves of product, preferably remain laden with product M.

When the applicators at which the invention is aimed are subjected to a wringing-out operation, prior to the application of product, wringing out is preferably performed randomly. This is because the roughnesses B are arranged in such a way that microreserves of product are present over the entire surface of each bristle. Preferably, these microreserves are capable of transferring product very evenly onto the support that is to be treated.

Figure 4:
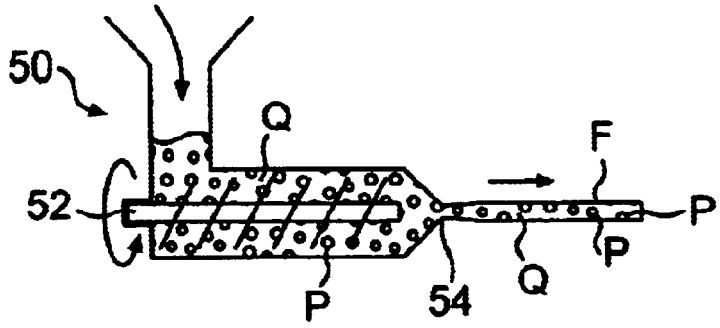
FIG. 4 is a partially schematic side view of a step in a method of manufacturing the bristle with surface roughness.
Figure 5:
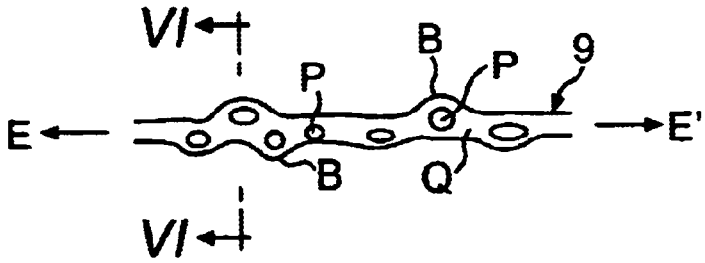
FIG. 5 is a side view showing stretching during manufacture of one embodiment of a bristle with surface roughnesses.

One method of producing bristles that can be used according to the present invention is illustrated diagrammatically in FIGS. 4 and 5.

A mixture of a thermoplastic material Q and of an appropriate amount of particles P is loaded into an extruder machine 50 equipped with a screw loader 52. The thermoplastic material is, for example, a polyamide, and the particles are globular particles of titan dioxide. The mixture is raised to a temperature that will allow the thermoplastic material to be extruded. Under the thrust of the loader 52, the mixture (P, Q) is extruded through a die 54. The filament or strand F thus obtained has an essentially smooth surface. After cooling, for example in a bath of cold water (not depicted), the material Q of the fibre F forming the matrix contracts, revealing the roughnesses B. To further accentuate the appearance of the roughnesses B, the fibre is preferably heated back up to a temperature close to the glass transition temperature. The fibre F can then be subjected to longitudinal drawing (i.e., stretching), as symbolized by the arrows, E, E' in FIG. 5. After cooling and after cutting to the desired length, bristles 9 can be attached to an applicator as previously described are obtained.

Once the fibre F has been drawn as shown in FIG. 5, it has a diameter corresponding to about 60% to about 95% of the diameter that the fibre had prior to drawing.

Figure 6:
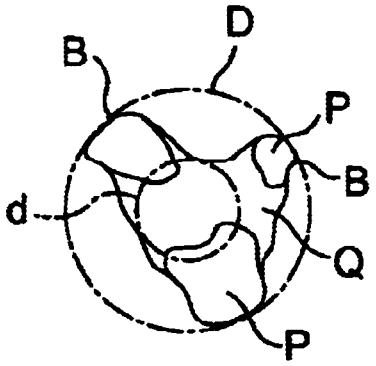
FIG. 6 is a cross-section view taken along line VI—VI of FIG. 5 showing one embodiment of a bristle.

FIG. 6 shows a cross section taken along plane VI—VI of FIG. 5. A matrix Q of the bristle 9, made of thermoplastic material, can be seen, with the roughnesses B, formed by the particles P incorporated into the matrix Q, emerging from its surface. According to the depiction of FIG. 6, the size of the particles P is relatively large.

Figure 7:
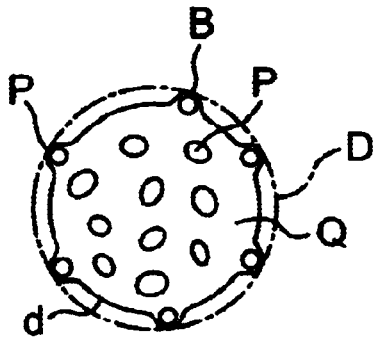
FIG. 7 is a cross-section view similar to FIG. 6 showing another embodiment of a bristle.

In an alternative form shown in FIG. 7, use is made of particles P of a markedly smaller size than the size of the particles of FIG. 6. In consequence, the roughnesses B emerge from the matrix Q to a lesser extent.

In FIGS. 6 and 7, the ratio between the mean diameter (D) of a circle in which the cross section of the bristles at the tops of the roughnesses (B) can be inscribed and the mean diameter (d) of a circle in which the cross section of the bristles at the base of the roughnesses can be inscribed may advantageously be between about 1.05 to about 1.4.

Depending on the cross section of the bristle the mean size of the particles, and the amount of drawings performed, by the particles (P) may be present in the bristles in a proportion of from about 0.2% to about 20% by volume and preferably in a proportion of about 2% to about 10% and more particularly in a proportion of about 2.5% to about 6% with respect to the total volume of the said bristles.

Advantageously, the said particles (P) are chosen from particles whose mean size (i.e., average diameter) is between about 2 $\mu$m and about 500 $\mu$m, and preferably between about 5 $\mu$m and about 200 $\mu$m and more particularly between about 10 $\mu$m and about 150 $\mu$m.

FIGS. 8 to 18 illustrate examples of bristle configurations which could be used for the applicators 6, 106, 206 described hereinabove. In these figures, the reference P denotes the particles incorporated into the structure of the bristle, the reference B denotes the roughnesses formed, the reference C denotes a longitudinal or helical ridge and the reference G denotes a longitudinal or helical groove formed in the surface of the bristles depicted.

Figure 8:
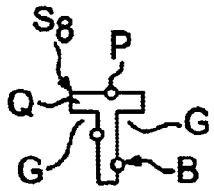
FIG. 8 is a cross-section view of a bristle in a shape of a "T"

FIG. 8 shows a cross-sectional view of a bristle, the cross section S8 of which is in the shape of a "T", with two grooves G.

Figure 9:
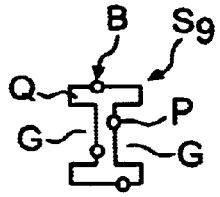
FIG. 9 is a cross-section view of a bristle in a shape of an "I"

FIG. 9 shows a cross-sectional view of a bristle, the cross section S9 which is in the shape of an "I" with two grooves G.

Figure 10:
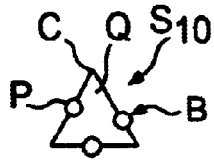
FIG. 10 is a cross-section view of a bristle in a shape of an isosceles triangle.

FIG. 10 shows a cross-sectional view of a bristle whose cross section S10 has the shape of an isosceles triangle, with three ridges C.

Figure 11:
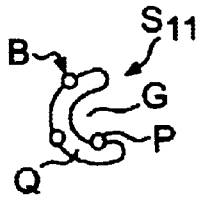
FIG. 11 is a cross-section view of a bristle in a shape of a "C"

FIG. 11 shows a cross-section view of a bristle, whose cross section S11 has the shape of a "C" with one groove G.

Figure 12:
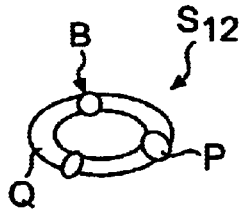
FIG. 12 is a cross-section view of a bristle in a shape of an oval hollow bristle.

FIG. 12 shows a cross-sectional view of a hollow bristle, the cross section S12 of which is in the shape of an oval.

Figure 13:
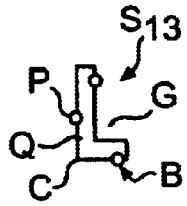
FIG. 13 is a cross-section view of a bristle in a shape of an "L"

FIG. 13 shows a cross-sectional view of a bristle, whose cross section S13 is in the shape of an "L", with one groove G and one ridge C.

Figure 14:
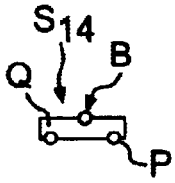
FIG. 14 is a cross-section view of a bristle in a shape of a rectangle.

FIG. 14 shows a cross-sectional view of a bristle, whose cross section S14 has the shape of a rectangle.

Figure 15:
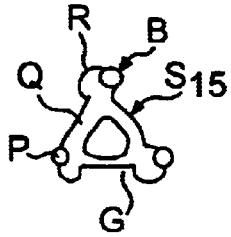
FIG. 15 is a cross-section view of a bristle in a shape of a triangular hollow bristle.

FIG. 15 shows a cross-sectional view of a hollow bristle, whose cross section S15 is roughly in the shape of a triangle, and the ridges of which are formed by bulges R.

Figure 16:
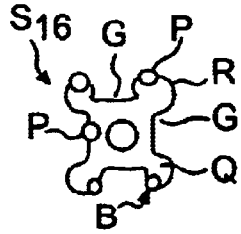
FIG. 16 is a cross-section view of a bristle in a shape of a rectangular hollow bristle.

FIG. 16 shows a cross-sectional view of a hollow bristle, whose cross section S16 is roughly the shape of a rectangle, and the ridges of which are formed by bulges R.

Advantageously, the cross section of the above bristles can be inscribed in a circle whose mean diameter is between 6/100ths of a mm and 30/100ths of a mm, measured at the tops of the roughnesses B.

The matrix Q of the bristles 9 can be made of polyamide (PA 6, PA 6, 6, PA 11, PA 6, 10, PA 6, 12), of polyester, of polyethylene, of polypropylene, of ethylene/propylene copolymer, of polyvinyl chloride, of Teflon, of polyethylene terephthalate or of thermoplastic elastomer, such as polyether-block-amides or silicon rubbers.

The bristles with roughnesses B may have cross sections in the shape of a cross, trilobe, tetralobe, solid oval, hollow oval (S12), solid cylinder, hollow cylinder, solid rectangle (S14), hollow rectangle, solid polygon, such as triangle (S10), hollow polygon, "8", "C" (S11), "E", "F", "H", "I" (S9), "L" (S13), "N", "S", "T" (S8), "V", "W", a star or a crescent.

The bristles 9 can be mixed with bristle of all kinds, even those with smooth surfaces lacking roughnesses. Thus, in one and the same applicator, it is possible to arrange bristles with roughnesses B together with bristles without roughnesses, together with bristles of a different cross section and/or together with bristles made of different materials.

Figure 17:
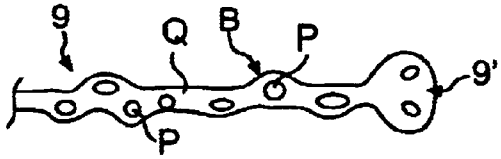
FIG. 17 is an end view of a bristle in the shape of a pin head.
Figure 18:
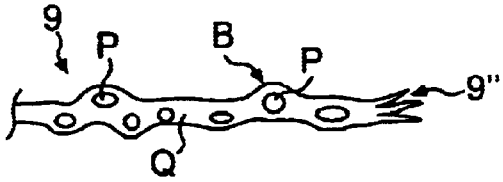
FIG. 18 is an end view of a bristle having a ragged end.

FIGS. 17 and 18 illustrate bristles 9 that can be used according to the invention. The free ends of these bristles have undergone a treatment. FIG. 17 shows a view in longitudinal section of the free end of a bristle 9 in the shape of a pinhead 9', obtained by heat treating the end. As shown this free end of bristles 9 may also have a rounded shape. FIG. 18 shows a view in longitudinal section of the free end of a bristle 9 of ragged appearance 9", such as may be obtained by milling or performing any other abrasive operation on the free end. The ragged appearance 9' may provide a tapered or forked end.

It will be apparent to those skilled in the art that various modifications and variations can be made to the structure and methodology of the present invention with departing from the scope or spirit of the invention. Thus, it should be understood that the invention is not limited to the examples discussed in the specification. Rather, the present invention is intended to cover modifications and variations of this invention, provided they fall within the scope of the following claims and their equivalents.

What is claimed is:

1. An application device for applying a cosmetic product, comprising:

a wand; and an applicator member on said wand, the applicator member including a plurality of bristles configured to apply a cosmetic product other than toothpaste, wherein at least one bristle of the plurality of bristles includes a plurality of particles providing roughness on at least a portion of the outer surface of the at least one bristle, and wherein the at least one bristle is non-tapered.

2. The application device according to claim 1, wherein the plurality of particles comprise a material chosen from at least one of inorganic origin, vegetable origin, and synthetic origin.

3. The application device according to claim 1, wherein the plurality of particles are chosen from one of globular particles, lamellar particles, and fibrous particles.

4. The application device according to claim 1, wherein the particles comprise a material chosen from one of mica, $CaCO_3$, ZnO, $TiO_2$, MgO, $Al_2O_3$, cotton, cellulose, silica, silicates, talc, clay, urea/formaldehyde, powdered wood, graphite, carbon, at least one metal, and mixtures thereof.

5. The application device according to claim 1, wherein the size of each of said plurality of particles region from about 2 $\mu$m to about 500 $\mu$m.

6. The application device according to claim 5, wherein the size of each of said plurality of particles ranges from about 5 $\mu$m to about 200 $\mu$m.

7. The application device according to claim 6, wherein the size of each of said plurality of particles ranges from about 10 $\mu$m to about 150 $\mu$m.

8. The application device according to claim 1, wherein the at least one bristle comprises a matrix and at least some of the plurality of particles are provided therein.

9. The application device according to claim 8, wherein the matrix comprises a material chosen from one of polyamide, polyester, polyethylene, polypropylene, polyvinyl chloride, polytetrafluorethylene, polyethylene terephthalate, thermoplastic elastomer, and vulcanized elastomer.

10. The application device according to claim 1, wherein a cross-section of each bristle of the plurality of bristles is sized such that the cross-section fits inside a circle having a diameter ranging from about 6/100ths of a mm to about 30/100ths of a mm.

11. The application device according to claim 10, wherein the cross-section of each bristle of the plurality of bristles is sized such that the cross-section fits inside a circle having a diameter ranging from about 6/100ths of a mm to about 20/100ths of a mm.

12. The application device according to claim 1, wherein a cross-section of the at least one bristle is sized such that the cross-section has a first mean diameter of a top of each of the particles, and the cross-section has a second mean diameter at a base of each of the particles, wherein a ratio of the first mean diameter to the second mean diameter ranges from about 1.05 to about 1.4.

13. The application device according to claim 1, wherein the plurality of particles in the at least one bristle make up from about 0.2% to about 20% by volume of the total volume of the at least one bristle.

14. The application device according to claim 13, wherein the plurality of particles of the at least one bristle provide from about 2% to about 10% by volume of the total volume of the at least one bristle.

15. The application according to claim 14, wherein the plurality of particles of the at least one bristle provide from about 2.5% to about 6% by volume of the total volume of the at least one bristle.

16. The application device according to claim 1, wherein the plurality of particles provide from about 0.2% to about 20% by volume of the total volume of the plurality of bristles.

17. The application device according to claim 1, wherein a shape of an end of at least one of the plurality of bristles is one of rounded, forked, and pinhead shaped.

18. The application device according to claim 1, wherein the plurality of bristles includes at least one bristle of a first length and at least one bristle of a second length greater than the first length.

19. The application device according to claim 1, wherein a length of each of the plurality of bristles ranges from about 2 mm to about 25 mm.

20. The application device according to claim 1, wherein the at least one bristle comprises at least one groove.

21. The application device according to claim 20, wherein a shape of the at least one groove is chosen from longitudinal and helical.

22. The application device according to claim 1, wherein the at least one bristle comprises at least one ridge.

23. The application device according to claim 22, wherein a shape of the at least one ridge is chosen from longitudinal and helical.

24. The application device according to claim 1, wherein a shape of a cross-section of the each of the bristles is chosen from at least one of a shape of a cross, trilobe, tetralobe, solid oval, hollow oval, solid cylinder, hollow cylinder, solid rectangle, hollow rectangle, triangle, solid polygon, hollow polygon, a figure-8, a C, an E, an F, an H, an I, an L, an N, an S, a T, a V, a W, a star, and a crescent.

25. The application device according to claim 1, wherein the plurality of bristles includes at least one tuft of bristles extending substantially parallel to one another, one end of each of the bristles in the tuft being fixed to the wand.

26. The application device according to claim 25, further comprising a handle on an end of the wand opposite to the applicator member.

27. The application device according to claim 1, wherein the application device is configured in the form of one of a nail varnish brush, a blusher brush, a lipstick brush, and an eyeliner brush.

28. The application device according to claim 1, wherein the applicator member includes a core, and the plurality of bristles extend substantially radially from the core.

29. The application device according to claim 28, wherein the core includes two twisted-together branches of wire.

30. The application device according to claim 29, wherein the plurality of bristles are trapped between the twisted-together branches of the core.

31. The application device according to claim 28, wherein the core defines an axis coincident with a central axis of the applicator member.

32. The application device according to claim 1, wherein each of the plurality of bristles includes the particles providing roughness.

33. An application device for applying a cosmetic product, comprising:

a wand; and an applicator member on said wand, the applicator member including a plurality of bristles configured to apply a cosmetic product, wherein at least one bristle of the plurality of bristles includes a plurality of particles providing roughness on at least a portion of the outer surface of the at least one bristle, wherein some of the plurality of bristles lack the particles providing roughness.

34. A method of applying a cosmetic product to a surface region of a body, comprising:

providing the application device of claim 1;

placing a cosmetic product on the applicator member; and transferring the cosmetic product from the applicator member to a surface region of a body.

35. The method of claim 34, wherein a portion of the application device is configured to be grasped by a user during application of the product, and wherein the method further comprises grasping the portion.

36. The applicator device according to claim 1, wherein the plurality of bristles comprises at least a one second bristle including a plurality of particles differing from the plurality of particles of the at least one bristle.

37. The application device according to claim 1, wherein at least one bristle of the plurality of bristles is nonparallel to at least one other bristle of the plurality of bristles.

38. A cosmetic application system comprising:

an application device for applying a cosmetic product, comprising:

a wand, and an applicator member on said wand, the applicator member including a plurality of bristles configured to apply a cosmetic product, wherein at least one bristle of the plurality of bristles includes a plurality of particles providing roughness on at least a portion of the outer surface of the at least one bristle; and a reservoir configured to contain a cosmetic product capable of being applied with the application device, wherein the reservoir includes an opening and a wiper configured to remove excess product from the applicator member when the applicator member is withdrawn from the reservoir.

39. The application system according to claim 38, wherein the wiper is configured to remove excess material form the wand.

40. The application system according to claim 38, wherein the wiper comprises an elastomeric material and includes at least one passage through which the applicator member can pass.

41. The application system according to claim 38, wherein the wiper comprises a foam material and includes at least one passage through which the applicator member can pass.

42. The application system according to claim 38, wherein the wiper includes at least one slit extending across a substantial portion of a cross-section of the wiper.

43. The application system according to claim 38, wherein at least one bristle of the plurality of bristles is nonparallel to at least one other bristle of the plurality of bristles.

44. The application system according to claim 43, wherein the at least one bristle including particles is non-tapered.

45. The application system according to claim 38, wherein the at least one bristle is non-tapered.

46. A method of forming at least one non-tapered bristle having a plurality of particles providing roughness on at least a portion of the outer surface of the bristle, the method comprising:

preparing a mixture of a thermoplastic material and a plurality of particles such that particles make up from about 0.2% to about 20% by volume of the total volume of the mixture;

heating the mixture;

extruding the mixture through a die to form a strand;

cooling the strand at least once;

raising the temperature of the strand to allow at least some of the particles to emerge at the surface of the strand; and cutting the strand to a desired length for the bristle, wherein the at least one bristle formed in the method is non-tapered.

47. The method of claim 46, wherein the cooling of the strand includes placing the strand in contact with a bath of liquid at a temperature lower than the temperature of the strand during the extruding.

48. The method of claim 46, wherein raising the temperature of the strand includes heating the strand in an oven, wherein the strand is heated to about a glass transition temperature of the thermoplastic material.

49. The method of claim 46, further comprising stretching the strand.

50. The method of claim 49, wherein the strand has an initial diameter and the stretching of the strand reduces the diameter of the strand from about 60% to about 90% of the initial diameter.

51. A cosmetic application system comprising:

an application device for applying a cosmetic product, comprising a wand, and an applicator member on said wand, the applicator member including a plurality of bristles configured to apply a cosmetic product, wherein at least one bristle of the plurality of bristles includes a plurality of particles providing roughness on at least a portion of the outer surface of the at least one bristle, and wherein the at least one bristle is non-tapered; and a reservoir configured to contain a cosmetic product capable of being applied with the application device.

52. The application system according to claim 51, wherein the reservoir contains the cosmetic product.

53. The application system according to claim 52, wherein the cosmetic product is one of mascara and nail varnish.

54. The application system according to claim 52, wherein the cosmetic product is one of an eye make-up product and a nail treatment product.

55. The application system according to claim 51, further comprising a handle on an end of the wand opposite the applicator member, a portion of the handle being configured to removably close an opening in the reservoir.

56. An application device for applying a cosmetic product, comprising:

a wand; and an applicator member on said wand, the applicator member including a plurality of bristles configured to apply a cosmetic product other than toothpaste, wherein at least one bristle of the plurality includes a plurality of particles providing roughness on at least a portion of the outer surface of the at least one bristle, and wherein the particles lack clay and lack silica.

57. The application device according to claim 56, wherein at least one bristle of the plurality of bristles is nonparallel to at least one other bristle of the plurality of bristles.

58. The application device according to claim 57, wherein the at least one bristle including particles is non-tapered.

59. The application device according to claim 56, wherein the at least one bristle is non-tapered.

60. A cosmetic application system comprising:

the application device of claim 56; and a reservoir configured to contain a cosmetic product capable of being applied with the application device, wherein the reservoir includes an opening and a wiper configured to remove excess product from the applicator member when the applicator member is withdrawn from the reservoir.

61. The application device according to claim 56, wherein the particles comprise a material chosen from one of mica, ZnO, $TiO_2$, MgO, $Al_2O_3$, cotton, cellulose, talc, urea/formaldehyde, powdered wood, graphite, carbon, and mixtures thereof.

62. The application device according to claim 56, wherein the plurality of particles comprise a material chosen from at least one of inorganic origin, vegetable origin, and synthetic origin.

63. The application device according to claim 56, wherein the plurality of particles are chosen from one of globular particles, lamellar particles, and fibrous particles.

64. The application device according to claim 56, wherein the particles comprise a material chosen from one of mica, $CaCO_3$, ZnO, $TiO_2$, MgO, $Al_2O_3$, cotton, cellulose, talc, urea/formaldehyde, powdered wood, graphite, carbon, at least one metal, and mixtures thereof.

65. The application device according to claim 56, wherein the size of each of said plurality of particles ranges from about 2 $\mu$m to about 500 $\mu$m.

66. The application device according to claim 65, wherein the size of each of said plurality of particles ranges from about 5 $\mu$m to about 200 $\mu$m.

67. The application device according to claim 66, wherein the size of each of said plurality of particles ranges from about 10 $\mu$m to about 150 $\mu$m.

68. The application device according to claim 56, wherein the at least one bristle comprises a matrix and at least some of the plurality of particles are provided therein.

69. The application device according to claim 68, wherein the matrix comprises a material chosen from one of polyamide, polyester, polyethylene, polypropylene, polyvinyl chloride, polytetrafluorethylene, polyethylene terephthalate, thermoplastic elastomer, and vulcanized elastomer.

70. The application device according to claim 56, wherein a cross-section of each bristle of the plurality of bristles is sized such that the cross-section fits inside a circle having a diameter ranging from about 6/100ths of a mm to about 30/100ths of a mm.

71. The application device according to claim 70, wherein the cross-section of each bristle of the plurality of bristles is sized such that the cross-section fits inside a circle having a diameter ranging from about 6/100ths of a mm to about 20/100ths of a mm.

72. The application device according to claim 56, wherein a cross-section of the at lest one bristle is sized such that the cross-section has a first mean diameter at a top of each of the particles, and the cross-section has a second mean diameter at a base of each of the particles, wherein a ratio of the first mean diameter to the second mean diameter ranges from about 1.05 to about 1.4.

73. The application device according to claim 56, wherein the plurality of particles in the at least one bristle make up from about 0.2% to about 20% by volume of the total volume of the at least one bristle.

74. The application device according to claim 73, wherein the plurality of particles of the at least one bristle provide from about 2% to about 10% by volume of the total volume of the at least one bristle.

75. The application device according to claim 74, wherein the plurality of particles of the at lest one bristle provide from about 2.5% to about 6% by volume of the total volume of the at least one bristle.

76. The application device according to claim 56, wherein the plurality of particles provide from about 0.2% to about 20% by volume of the total volume of the plurality of bristles.

77. The application device according to claim 56, wherein a shape of an end of at least one of the plurality of bristles is one of rounded, tapered, forked, and pinhead shaped.

78. The application device according to claim 56, wherein the plurality of bristles includes at least one bristle of a first length and at least one bristle of a second length greater than the first length.

79. The application device according to claim 56, wherein a length of each of the plurality of bristles ranges from about 2 mm to about 25 mm.

80. The application device according to claim 56, wherein the at least one bristle comprises at least one groove.

81. The application device according to claim 80, wherein a shape of the at least one groove is chosen from longitudinal and helical.

82. The application device according to claim 56, wherein the at least one bristle comprises at least one ridge.

83. The application device according to claim 82, wherein a shape of the at least one ridge is chosen from longitudinal and helical.

84. The application device according to claim 56, wherein a shape of a cross-section of the each of the bristles is chosen from at least one of a shape of a cross, trilobe, tetralobe, solid oval, hollow oval, solid cylinder, hollow cylinder, solid rectangle, hollow rectangle, triangle, solid polygon, hollow polygon, a figure-8, a C, an E, an F, an H, an I, an L, an N, an S, a T, a V, a W, a star, and a crescent.

85. The application device according to claim 56, wherein the plurality of bristles includes at least one tuft of bristles extending substantially parallel to one another, one end of each of the bristles in the tuft being fixed to the wand.

86. The application device according to claim 85, further comprising a handle on an end of the wand opposite to the applicator member.

87. The application device of claim 56, wherein the application device is configured in the form of one of a nail varnish brush, a blusher brush, a lipstick brush, and an eyeliner brush.

88. The application device according to claim 56, wherein the applicator member includes a core, and the plurality of bristles extend substantially radially from the core.

89. The application device of claim 88, wherein the core includes two twisted-together branches of wire.

90. The application device according to claim 89, wherein the plurality of bristles are trapped between the twisted-together branches of the core.

91. The application device according to claim 90, wherein the core defines an axis coincident with a central axis of the applicator member.

92. The application device according to claim 56, wherein each of the plurality of bristles includes the particles providing roughness.

93. A method of applying a cosmetic product to a surface region of a body, comprising:

providing the application device of claim 56;

placing a cosmetic product on the applicator member; and transferring the cosmetic product from the applicator member to a surface region of a body.

94. The method of claim 93, wherein a portion of the application device is configured to be grasped by a user during application of the product, and wherein the method further comprises grasping the portion.

95. The method of claim 93, wherein the product is a nail treatment product and the surface region includes at least one of a fingernail and a toenail.

96. The application device according to claim 56, wherein the plurality of bristles comprises at least a one second bristle including a plurality of particles differing from the plurality of particles of the at least one bristle.

97. The application device according to claim 56, wherein at least one bristle of the plurality of bristles is nonparallel to at least one other bristle of the plurality of bristles.

98. The application device according to claim 56, wherein the at least one bristle is non-tapered.

99. The method of claim 34, wherein the product is a nail treatment product and the surface region includes at least one of a fingernail and a toenail.

100. An application device for applying a cosmetic product, comprising:

a wand; and an applicator member on said wand, the applicator member including a plurality of bristles configured to apply a cosmetic product other than toothpaste, wherein at least one bristle of the plurality of bristles includes a plurality of particles providing roughness on at least a portion of the outer surface of the at least one bristle, and wherein the particles comprise a material chosen from one of mica, ZnO, $TiO_2$, MgO, $Al_2O_3$, cotton, cellulose, talc, urea/formaldehyde, powdered wood, graphite, carbon, and mixtures thereof.

101. The application device according to claim 100, wherein at least one bristle of the plurality of bristles is nonparallel to at least one other bristle of the plurality of bristles.

102. The application device according to claim 100, wherein the at least one bristle is non-tapered.

103. The application device according to claim 101, wherein the at least one bristle including particles is non-tapered.

104. A cosmetic application system comprising:

the application device of claim 100; and a reservoir configured to contain a cosmetic product capable of being applied with the application device, wherein the reservoir includes an opening and a wiper configured to remove excess product from the applicator member when the applicator member is withdrawn from the reservoir.

* * * * *

UNITED STATES PATENT AND TRADEMARK OFFICE

CERTIFICATE OF CORRECTION

PATENT NO. : 6,623,200 B1 
DATED : September 23, 2003
INVENTOR(S) : Jean-Louis H. Gueret It is certified that error appears in the above-identified patent and that said Letters Patent is hereby corrected as shown below:

Column 12,
Line 31, please delete “region” and replace with -- ranges --.
Line 45, please replace “polytetrafluorethylene,” with -- polytetrafluroethylene, --.

Column 13,
Line 5, after “application”, please insert -- device --.

Column 14,
Line 31, please replace “comprising:” with -- comprising --.
Line 47, please replace “form” with -- from --.

Column 15,
Line 63, after the first occurrence of “plurality” please insert -- of bristles --.

Column 16,
Line 48, please replace “polytetrafluorethylene,” with -- polytetrafluroethylene, --.

Column 17,
Line 10, please replace “lest” with -- least --.

Signed and Sealed this

Eighteenth Day of November, 2003

JAMES E. ROGAN
*Director of the United States Patent and Trademark Office*